US010041146B2

(12) United States Patent
Sernik et al.

(10) Patent No.: US 10,041,146 B2
(45) **Date of Patent: *Aug. 7, 2018**

(54) PROCESSES FOR PRODUCING LOW NITROGEN METALLIC CHROMIUM AND CHROMIUM-CONTAINING ALLOYS AND THE RESULTING PRODUCTS

(71) Applicant: Companhia Brasileira de Metalurgia e Mineração, Araxá (BR)

(72) Inventors: Kleber A. Sernik, Greensburg, PA (US); Alaercio Salvador Martins Vieria, Araxa (BR); Adriano Porfirio Rios, Araxa (BR); Daniel Pallos Fridman, Araxa (BR)

(73) Assignee: Companhia Brasileira de Metalurgia e Mineraçäo, Araxá (BR)

( * ) Notice: Subject to any disclaimer, the term of this patent is extended or adjusted under 35 U.S.C. 154(b) by 560 days.

This patent is subject to a terminal disclaimer.

(21) Appl. No.: 14/533,741

(22) Filed: Nov. 5, 2014

(65) Prior Publication Data

US 2016/0122848 A1 May 5, 2016

(51) Int. Cl.

| | |
|---|---|
| ***C22B 34/32*** | (2006.01) |
| ***C22B 5/04*** | (2006.01) |
| ***C22B 9/04*** | (2006.01) |
| ***C22C 19/05*** | (2006.01) |
| ***C22C 1/04*** | (2006.01) |
| ***C22C 1/06*** | (2006.01) |
| ***C22C 27/06*** | (2006.01) |

(52) U.S. Cl.

CPC ..... *C22B 34/32* (2013.01); *C22B 5/04* (2013.01); *C22B 9/04* (2013.01); *C22C 1/045* (2013.01); *C22C 1/06* (2013.01); *C22C 19/05* (2013.01); *C22C 27/06* (2013.01)

(58) Field of Classification Search

CPC .. C22C 1/06; C22C 27/06; C22B 5/00; C22B 5/02; C22B 5/04; C22B 5/16; C22B 5/18; C22B 5/20; C22B 9/00; C22B 9/003; C22B 9/006; C22B 9/04; C22B 9/05; C22B 9/055; C22B 9/10; C22B 9/103; C22B 9/106; C22B 9/14; C22B 9/16; C22B 9/18; C22B 9/20; C22B 34/30; C22B 34/32; C22B 34/325

See application file for complete search history.

(56) References Cited

U.S. PATENT DOCUMENTS

| | | | | |
|---|---|---|---|---|
| 2,953,443 | A * | 9/1960 | Lloyd | A47J 36/30 102/202.14 |
| 4,150,975 | A * | 4/1979 | Miyake | C22B 34/32 423/53 |
| 4,169,722 | A * | 10/1979 | Fletcher | C22B 5/04 420/417 |
| 4,331,475 | A | 5/1982 | Perfect | |
| 4,612,047 | A * | 9/1986 | Schmidt | C22C 33/00 148/301 |
| 4,917,726 | A | 4/1990 | Chou et al. | |
| 5,086,720 | A | 2/1992 | Gibran | |
| 5,092,921 | A | 3/1992 | Kobayashi et al. | |
| 5,196,048 | A * | 3/1993 | Antrim | C01B 3/0031 164/61 |
| 5,259,866 | A | 11/1993 | Kobayashi et al. | |
| 5,364,587 | A | 11/1994 | Perfect | |
| 5,422,069 | A | 6/1995 | Perfect | |
| 6,458,182 | B2 | 10/2002 | Shindo et al. | |
| 7,361,205 | B2 * | 4/2008 | Liebaert | C21C 5/5264 75/351 |

(Continued)

FOREIGN PATENT DOCUMENTS

| | | |
|---|---|---|
| CN | 1394974 A | 2/2003 |
| CN | 101440436 | 5/2009 |

(Continued)

OTHER PUBLICATIONS

R.N. Caron and J.T. Staley, Effects of Composition, Processing, and Structure on Properties of Nonferrous Alloys, Materials Selection and Design, vol. 20, ASM Handbook, ASM International, 1997, pp. 383-415 (print version), pp. 1-12 pages (online version).*

Min et al., "Modern Nickel Superalloys and the Efficient Resource-Saving Technologies of Their Production", Russian Metallurgy, vol. 2015, No. 13, pp. 1060-1068, 2015.

Choudhury, "State of the Art of Superalloy Production for Aerospace and Other Application Using VIN/VAR or VIM/ESR", ISIJ International, vol. 32, No. 5, pp. 563-574, Jan. 1, 1992.

Weber, "Nickel-based Superalloys: Alloying Methods and Thermomechanical Processing", The Concise Encyclopedia of Materials Processing, pp. 6149-6154, Jan. 1, 2009.

PCT International Search Report and Written Opinion dated Aug. 24, 2016, issued during the prosecution of PCT International Patent Application No. PCT/IB2015/002636 (12 pages).

(Continued)

*Primary Examiner* — Scott Kastler
*Assistant Examiner* — Vanessa T Luk
(74) *Attorney, Agent, or Firm* — Locke Lord LLP; Alicia J. Carroll

(57) ABSTRACT

Processes for producing low-nitrogen metallic chromium or chromium-containing alloys, which prevent the nitrogen in the surrounding atmosphere from being carried into the melt and being absorbed by the metallic chromium or chromium-containing alloy during the metallothermic reaction, include vacuum-degassing a thermite mixture comprising metal compounds and metallic reducing powders contained within a vacuum vessel, igniting the thermite mixture to effect reduction of the metal compounds within the vessel under reduced pressure i.e., below 1 bar, and conducting the entire reduction reaction in said vessel under reduced pressure, including solidification and cooling, to produce a final product with a nitrogen content below 10 ppm. The final products obtained, in addition to low-nitrogen metallic chromium in combination with other elements, can be used as raw materials in the manufacture of superalloys, stainless steel and other specialty steels whose final content of nitrogen is below 10 ppm.

10 Claims, No Drawings

(56) References Cited

U.S. PATENT DOCUMENTS

| | | | |
|---|---|---|---|
| 8,496,046 | B2 | 7/2013 | Nakayama et al. |
| 2006/0110626 | A1 | 5/2006 | Ziani et al. |
| 2012/0034127 | A1 | 2/2012 | Harris |
| 2016/0122853 | A1 | 5/2016 | Sernik |

FOREIGN PATENT DOCUMENTS

| | | | |
|---|---|---|---|
| CN | 102965526 | A | 3/2013 |
| CN | 105624436 | A | 6/2016 |
| DE | 69920925 | T2 | 3/2006 |
| EP | 0236505 | A1 | 9/1987 |
| EP | 0426375 | A1 | 5/1991 |
| EP | 0482808 | A1 | 4/1992 |
| GB | 2204595 | | 11/1988 |
| JP | 52036508 | A | 3/1977 |
| JP | S63199832 | A | 8/1988 |
| JP | 19891040899 | | 9/1989 |
| JP | 04193784 | B2 | 12/2008 |
| RU | 2214471 | C2 | 10/2003 |

OTHER PUBLICATIONS

Mitchell, et al., "Solidification and Precipitation in IN718", Superalloys 718, 625, 706 and Various Derivatives, ed. E.A. Loria, The Minerals, Metals & Materials Society, 2001.

Mitchell et al., "The Precipitation of Primary Carbides in Alloy 718", Superalloys 718, 625, 706 and Various Derivatives, ed. E.A. Loria, The Minerals, Metals & Materials Society, 1994.

AMS 5662 Rev. N, Issued: Sep. 1965, Reaffirmed: Jun. 2009, Revised Jun. 2016; SAE International.

International Search Report and Written Opinion dated Jul. 20, 2016 in connection with PCT/IB2015/002635.

X. S. Xie et al.: "Research and Development of Inconel 718 Type Superalloy," Materials Science Forum , vols. 539-453, pp. 262-269, 2007.

Perfect, F.H,: "Aluminothermic Chromium and Chromium Alloys, Low in Nitrogen," American Society for Metals and the Metallurgical Society of AIME, vol. 12B, pp. 611-612, Sep. 1981.

W. Singer et al.: "RRR-Measurement Techniques on High Purity Niobium," TTC-Report Feb. 2010, pp. 1-17.

Habashi, Fathi,"Metallothermic Reactions—a Short History," CIM Magazine, May 2012, pp. 1-2.

M. Vincent & Associates, Ltd, Specialty Metals: "Chemical Data, Mechanical Properties and Spcifications for Nickel Alloy C-276.", copyright 2016.

M. Vincent & Associates, Ltd, Specialty Metals: "Chemical Data, Mechanical Properties and Spcifications for Nickel Alloy C-22.", copyright 2016.

SAEAeropace—Aerospace Material Specification—Nickel Alloy, Corrosion and Heat-Resistant, Bars, Forgings, and Rings 52.5Ni—19Cr—3.0Mo—5.1Cb (Nb)—0.90Tl—0.50Ai—18Fe Consumable Electrode or Vacuum Induction Metled 1775º F (968º C) Solution Heat Treated, precipitation-Hardenable, copyright 2016.

API Standard 6A718: "Nickel Base Alloy 718 (UNS N07718) for Oil and Gas Driling and Production Equipment," Second Edition, Dec. 2009, Errata, Apr. 1, 2010.

JP1040899B—English translation of Abstract only, original document pub. Sep. 1, 1989.

European Office Action dated Feb. 20, 2018, issued during the prosecution of European Patent Application No. 15864318.9 (4 pages).

Perfect, F. H., "Metallothermic Reduction of Oxides in Water-Cooled Copper Furnaces", Transactions of the Metallurgical Society of AIME, Sep. 1967, pp. 1282-1286, vol. 239, No. 9, American Institute of Mining, Metallurgical, and Petroleum Engineers, Inc., New York.

W. Singer et al.: "RRR-Measurement Techniques on High Purity Niobium," TTC-Report Feb. 2010, pp. 1-17, 2010.

SAEAerospace—Aerospace Material Specification—Nickel Alloy, Corrosion and Heat-Resistant, Bars, Forgings, and Rings 52.5Ni—19Cr—3.0Mo—5.1Cb (Nb)—0.90Tl—0.5Ai—18FE Consumable Electrode or Vacuum Induction Melted 1775° F. (968° C.) Solution Heat Treated, precipitation-Hardenable. AMS 5662M Issued: Sep. 1965; Revised Jul. 2004; Reaffirmed: Jun. 2009.

Non-Final Office Action dated Jan. 10, 2017 issued in U.S. Appl. No. 14/533,843.

Wefang C. et al., "Preparation and Mechanical Properties of Ultra High Purity Fe-Cr Alloy", Gold Journal, vol. 3, No. 2, Jun. 2001, pp. 81-85.

Chinese Office Action dated Mar. 27, 2018, issued in Chinese Patent Application No. 201580060203.2, and English translation thereof, 16 pages.

Singapore Written Opinion dated Mar. 16, 2018 issued during the prosecution of Singapore Patent Application No. 11201702030T, 6 pages.

Non-Final Office Action dated May 17, 2018, issued in U.S. Appl. No. 15/463,217.

Chinese Office Action dated May 31, 2018, issued in Chinese Patent Application No. 201580060224.4, and English translation thereof, 28 pages.

Murray, G.T. et al., "Preparation and Characterization of Pure Metals, Properties and Selection: Nonferrous Alloys and Special-Purpose Materials," vol. 2, ASM Handbook, ASM International, 1990, pp. 1093-1097 (Year: 1990).

Search Report and Written Opinion Issued in Singapore Application No. 11201702084W dated Jun. 26, 2018.

* cited by examiner

PROCESSES FOR PRODUCING LOW NITROGEN METALLIC CHROMIUM AND CHROMIUM-CONTAINING ALLOYS AND THE RESULTING PRODUCTS

BACKGROUND OF THE INVENTION

1. Field of the Invention

The present invention relates to metallothermic processes for producing metallic chromium and its alloys. More specifically, the present invention relates to metallothermic processes for producing low-nitrogen metallic chromium and chromium-containing alloys and to the products obtained by said processes.

2. Description of Related Art

The lifespan of rotating metal parts in aircraft engines is typically determined by fatigue cracking. In this process, cracks are initiated at certain nucleation sites within the metal and propagate at a rate related to the material characteristics and the stress to which the component is subjected. That, in turn, limits the number of cycles the part will withstand during its service life.

Clean melting production techniques developed for superalloys have given rise to the substantial elimination of oxide inclusions in such alloys to the extent that nowadays, fatigue cracks are mainly originated on structural features, for example, on grain boundaries or clusters of primary precipitates such as carbides and nitrides.

It has been found that the primary nitride particles formed during the solidification of alloy 718 (see alloy 718 specifications (AMS 5662 and API 6A 718))—which is one of the main alloys utilized in the production of aircraft engine rotating parts and for oil and gas drilling and production equipment—are pure TiN (titanium nitride) and that the precipitation of primary Nb—TiC (niobium-titanium carbide) occurs by heterogeneous nucleation over the surface of the TiN particles, thereby increasing the precipitate particle size. The particle size can be decreased by two means: either by lowering the carbon content as much as possible, or by lowering the nitrogen content.

Many commercial specifications for stainless steel, other specialty steels, and superalloys, establish minimum carbon content, usually in order to prevent grain boundary slipping at the service temperature. As a consequence, the only practical means to decrease particle size compositionally is to reduce the nitrogen content in the material as extensively as possible. In that way, in as much as the nitrides precipitate first, removing nitrogen supersedes the importance of removing carbon.

It is known that removing the nitrogen and/or the nitrogen-containing precipitates after the reduction of a metal or metal alloy is an extremely difficult and expensive task. Therefore, nitrogen preferably should be removed before or during the reduction process.

There is a well known process for producing low nitrogen alloys called electron beam melting; it is very expensive and extremely slow when compared to a metallothermic reduction process and therefore, impractical from a commercial point of view. There is also a known aluminothermic reduction process (see, U.S. Pat. No. 4,331,475) which, as opposed to embodiments of the present invention, is not conducted under continuous reduced pressure resulting, at best, in a chromium master alloy, with a reduced nitrogen content of 18 ppm which, when used in alloy 718 production, cannot guarantee an alloy 718 whose nitrogen content is below the solubility limit of the titanium nitride precipitate.

SUMMARY OF THE INVENTION

In order to overcome the above-mentioned problems, which have plagued the aircraft and oil and gas industries for years, the present invention provides processes for producing low-nitrogen metallic chromium or chromium-containing alloys which prevent the nitrogen in the surrounding atmosphere from being carried into the melt and being absorbed by the metallic chromium or chromium-containing alloy during the metallothermic reaction. To such end, the processes of the present invention comprise the steps of: (i) vacuum-degassing a thermite mixture comprising metal compounds and metallic reducing powders contained within a vacuum vessel, (ii) igniting the thermite mixture to effect reduction of the metal compounds within the vessel under reduced pressure i.e., below 1 bar, and (iii) conducting the entire reduction reaction in said vessel under reduced pressure, including solidification and cooling, to produce a final product with a nitrogen content below 10 ppm.

In a first aspect of the processes of the present invention, the vacuum vessel can be a ceramic or metallic container lined with a refractory material.

In a second aspect of the processes of the present invention, the vacuum vessel is placed inside a vacuum-tight, water-cooled chamber, preferably a metallic chamber.

In a third aspect of the processes of the present invention, the pressure within the vacuum vessel is reduced, before ignition, to a pressure of less than about 1 mbar. And then, the pressure can be raised within the vessel through introduction of a non-nitrogenous gas, up to about 200 mbar to facilitate removal of by-products formed during the thermite reaction.

In a fourth aspect of the processes of the present invention, the resulting reaction products are solidified under a pressure below 1 bar.

In a fifth aspect of the processes of the present invention, the resulting reaction products are cooled to about ambient temperature under a pressure below 1 bar.

The present invention also provides:

Metallic chromium or chromium-containing alloys with a nitrogen content below 10 ppm.

The low-nitrogen metallic chromium and chromium-containing alloys with nitrogen content below 10 ppm are obtained through use of the above-mentioned processes of the present invention.

DETAILED DESCRIPTION OF THE PREFERRED EMBODIMENTS

Embodiments of the present invention provides processes for the production of low-nitrogen metallic chromium or low-nitrogen chromium-containing alloys comprising vacuum degassing a thermite mixture of metal oxides or other metal compounds and metallic reducing powders, reducing the oxides or compounds of that mixture in a reduced pressure, low-nitrogen atmosphere, thereby resulting in a metallic product with 10 ppm or less nitrogen in the produced weight.

Preferably, the thermite mixture comprises:

a) chromium oxides or other chromium compounds such as chromic acid and the like which can be reduced to produce metallic chromium and low-nitrogen chromium-containing alloys;

b) at least one reducing agent, such as aluminum, silicon, magnesium and the like, preferably in powder form;

c) at least one energy booster, such as a salt, e.g., $NaClO_3$, $KClO_4$, $KClO_3$, and the like, and/or a peroxide such as $CaO_2$ and the like, to provide high enough temperatures within the melt to insure good fusion and separation of metal and slag.

The processes of the embodiments of the present invention optionally include metallothermic reduction of chromium oxides or other chromium compounds such as chromic acid and the like to produce the metal or the reduction of chromium oxides or other chromium compounds together with other elements such as nickel, iron, cobalt, boron, carbon, silicon, aluminum, titanium, zirconium, hafnium, vanadium, niobium, tantalum, molybdenum, tungsten, rhenium, copper and mixtures thereof in their metallic form or as compounds thereof capable of metallothermic reduction.

Preferably, the reducing agent of the proposed mixture can be aluminum, magnesium, silicon, and the like; preferably, aluminum is employed in powder form.

The thermite reaction is carried out by charging the mixture to a ceramic or metallic vacuum vessel, preferably lined with refractory material. The vessel is placed inside a vacuum-tight, water-cooled chamber preferably, a metallic chamber, linked to a vacuum system. The vacuum system will remove the air within the vessel until the system achieves a pressure preferably lower than 1 mbar.

After achieving the reduced pressure condition, preferably lower than 1 mbar to assure removal of the nitrogen-containing atmosphere, the pressure within the system can be raised using a non-nitrogenous gas such as an inert gas, e.g., argon, or oxygen and the like, to a pressure up to about 200 mbar to facilitate removal of by-products formed during the thermite reaction. Once the thermite mixture is ignited, the pressure rises with the evolution of gases formed during the reaction, and, as the reaction products solidify and cool, the volume of the gases formed as a result of the reaction contracts and the pressure decreases but is always below 1 bar. In this manner, the reduction process is completed under reduced pressure over a period of time commensurate with the load weight, typically a few minutes. The process results in the formation of metallic chromium or a chromium-containing alloy containing below 10 ppm nitrogen. This is most important since there is ample evidence of the remarkable difficulty to remove nitrogen once it is present in chromium metal or chromium-containing alloys, even by resorting to techniques such as the much more expensive electron beam melting process.

The products obtained by the processes described above are permitted to solidify and cool down to about ambient temperature under the same low-nitrogen reduced pressure atmosphere so as to avoid nitrogen absorption in these final stages. It is considered critical in achieving the low nitrogen content metals and alloys of the embodiments of the present invention that the entire process from pre-ignition, ignition, solidification and cooling be conducted under reduced pressure as described herein.

Preferably, the metals or alloys produced will contain less than about 5 ppm nitrogen by weight. Most preferably, the metals or alloys produced will contain less than about 2 ppm nitrogen by weight.

The embodiments of the present invention further includes the products obtained by the processes described above in addition to low-nitrogen metallic chromium in combination with any other elements, which can be used as raw materials in the manufacture of superalloys, stainless steel or other specialty steels obtained by any other process, whose final content of nitrogen is below 10 ppm.

EXAMPLES

The following examples were conducted to establish the effectiveness of the embodiments of the present invention in obtaining low nitrogen chromium and chromium alloys.

In the following examples, an aluminothermic reduction reaction was effected in the manner disclosed below. Table 1 summarizes the composition of the materials charged to the reactor:

| | Example 1 Nb17—Cr68—Ni15 | | Example 2 Nb17—Cr68—Ni15 | |
|---|---|---|---|---|
| Target Alloy | (g) | (%) | (g) | (%) |
| $Nb_2O_5$ | 267 | 10.6 | 795 | 10.6 |
| $Cr_2O_3$ | 1093 | 43.4 | 3249 | 43.3 |
| $N_i$ | 165 | 6.5 | 490 | 6.5 |
| $KClO_4$ | 160 | 6.3 | 477 | 6.4 |
| Al | 571 | 22.6 | 1697 | 22.6 |
| CaO | 265 | 10.5 | 789 | 10.5 |
| Total | 2521 | 100.0 | 7497 | 100.0 |

In each example, the raw materials were charged to a rotating drum mixer and homogenized until the reactants were uniformly dispersed throughout the entire charge.

The vacuum chamber system was divided in an interior vacuum vessel and an external surrounding chamber. The interior vacuum chamber vessel was protected with a refractory lining to prevent overheating and to support the reactor vessel. The external chamber was made of steel and had a serpentine water conduit coiled in heat exchange relationship about it to cool and prevent its overheating as well as three ports integral therewith: a) an outlet for inner atmosphere removal; b) an inlet to permit backfilling with a non-nitrogenous gas; and c) an opening to connect the electrical ignition system with a power generator.

The reactor vessel was carefully placed inside the surrounding chamber and then was charged with the reaction mixture under the protection of an exhaustion system for dust removal.

Finally, the electrical ignition system was connected and the vacuum chamber was sealed.

The system had its inner atmosphere evacuated to 0.6 millibar (mbar) and was then backfilled with argon to a pressure of about 200 mbar. Then, the mixture was ignited with the electrical igniter inside the chamber under the low pressure inert atmosphere.

The aluminothermic reduction reaction took less than 3 minutes and gave rise to 800 mbar as the peak pressure and 1200° C. as the peak temperature.

Finally, the chromium alloy was removed from the reaction vessel after complete solidification and cooling under the low pressure inert atmosphere. The nitrogen content in the chromium alloy of Example 1 was 0.5 ppm and in Example 2 was 0 ppm.

Therefore, embodiments of the present invention provide processes conducted in a ceramic or metallic vacuum vessel with a refractory, e.g., ceramic, lining placed in a vacuum-tight, water-cooled chamber wherein the initial pressure is reduced under vacuum to a pressure less than about 1 mbar. With this equipment configuration, the extremely high temperature generated by the heat released by the thermite reaction is not a limiting factor for its feasibility, nor is the heat quantity carried by the gases and vapors generated in these processes.

The processes of embodiments of the present invention achieve extremely low nitrogen contents due to the fact that these processes are conducted entirely in a reduced pressure environment, i.e., below 1 bar, encompassing all phases of pre-ignition, ignition, solidification, and cooling.

Numerous variations of the parameters of embodiments of the present invention will be apparent to those skilled in the art and can be employed while still obtaining the benefits thereof. It is thus emphasized that the present invention is not limited to the particular embodiments described herein.

The invention claimed is:

1. Processes for producing metallic chromium or chromium-containing alloys with a nitrogen content of below 5 ppm comprising:

i) vacuum-degassing a thermite mixture comprising chromium compounds and metallic reducing agents, contained within a vacuum vessel capable of withstanding a thermite reaction, to an initial pressure less than 1 mbar, and backfilling the vacuum vessel with an inert gas to a pressure up to about 200 mbar;

ii) igniting the thermite mixture to effect reduction of the chromium compounds within said vessel under reduced pressure to generate a melt;

iii) solidifying the reaction products under reduced pressure; and iv) cooling the reaction products to about ambient temperature under reduced pressure, wherein igniting the thermite mixture and solidifying the reaction products are conducted under a pressure up to about 200 mbar, wherein the resulting alloy has a nitrogen content less than 5 ppm by weight.

2. Processes according to claim 1, wherein the vacuum vessel is a ceramic or metallic container lined with refractory material.

3. Processes according to claim 2, wherein the vacuum vessel is placed inside a vacuum-tight, water-cooled chamber for the entire reduction reaction.

4. Processes according to claim 1, wherein the reducing agent is aluminum.

5. Processes according to claim 4, wherein the aluminum reducing agent is in powder form.

6. Processes according to claim 1, wherein the thermite mixture additionally comprises at least one energy booster.

7. Processes according to claim 1, wherein the thermite mixture additionally contains an element selected from the group consisting of nickel, iron, cobalt, boron, carbon, silicon, aluminum, titanium, zirconium, hafnium, vanadium, niobium, tantalum, molybdenum, tungsten, rhenium, copper, and mixtures thereof in their metallic form or as compounds thereof capable of metallothermic reduction.

8. Processes according to claim 1, wherein the inert gas is a non-nitrogenous gas.

9. Process according to claim 1, wherein backfilling the vacuum vessel with the inert gas includes backfilling to a pressure of about 200 mbar.

10. Process according to claim 1, wherein igniting the thermite mixture and solidifying the reaction products are conducted under a pressure of about 200 mbar.

* * * * *